US008794193B2

(12) United States Patent
Araki et al.

(10) Patent No.: US 8,794,193 B2
(45) Date of Patent: Aug. 5, 2014

(54) ENGINE COOLING DEVICE

(75) Inventors: Yukari Araki, Chiryu (JP); Nobutaka Takeuchi, Miyoshi (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 147 days.

(21) Appl. No.: 13/510,999

(22) PCT Filed: Mar. 9, 2010

(86) PCT No.: PCT/JP2010/053843
§ 371 (c)(1),
(2), (4) Date: May 21, 2012

(87) PCT Pub. No.: WO2011/111159
PCT Pub. Date: Sep. 15, 2011

(65) Prior Publication Data

US 2012/0266828 A1 Oct. 25, 2012

(51) Int. Cl.
*F01P 7/00* (2006.01)
*F01P 7/14* (2006.01)

(52) U.S. Cl.
USPC ..... 123/41.02; 123/41.1; 123/41.44

(58) Field of Classification Search
USPC ..... 123/41.02, 41.08–41.1, 41.15, 41.44
See application file for complete search history.

(56) References Cited

U.S. PATENT DOCUMENTS

| | | | | |
|---|---|---|---|---|
| 4,381,736 | A * | 5/1983 | Hirayama | 123/41.1 |
| 6,425,353 | B1 | 7/2002 | Davies | |
| 6,520,125 | B2 * | 2/2003 | Suzuki et al. | 123/41.1 |
| 2009/0229543 | A1 | 9/2009 | Suzuki | |
| 2009/0301409 | A1 | 12/2009 | Dahl et al. | |
| 2010/0050960 | A1 | 3/2010 | Araki et al. | |

FOREIGN PATENT DOCUMENTS

| | | | |
|---|---|---|---|
| DE | 102 28 355 | A1 | 1/2004 |
| JP | 2002-530583 | A | 9/2002 |
| JP | 2006-214280 | A | 8/2006 |
| JP | 2007-127079 | A | 5/2007 |
| JP | 2007-170352 | A | 7/2007 |
| JP | 2007-218115 | A | 8/2007 |
| JP | 2008-169750 | A | 7/2008 |
| WO | 00/31388 | A1 | 6/2000 |

OTHER PUBLICATIONS

International Search Report for PCT/JP2010/053843 dated May 25, 2010.

* cited by examiner

*Primary Examiner* — Noah Kamen
(74) *Attorney, Agent, or Firm* — Sughrue Mion, PLLC

(57) ABSTRACT

Disclosed is a device for cooling an internal combustion engine in which circulation of cooling water is halted until the cooling water reaches a predetermined temperature, wherein decline in the durability of a radiator, which is caused by thermal strain that occurs when circulation of the cooling water is restarted and the cooling water is introduced into the radiator, is suppressed. An internal combustion engine (10) comprises an electric pump (23), a water temperature sensor (92), a radiator (21), and a thermostat (22). The water temperature sensor (92) detects a cooling water temperature (THW). The radiator (21) is capable of circulating the cooling water between the radiator (21) and an engine cooling system (13). If the cooling water temperature (THW) is equal to or greater than a valve opening temperature (TZ), the thermostat (22) opens and the cooling water is introduced into the radiator (21). An electronic control device (91) performs control in such a way that the discharge pressure of the cooling water is increased by the electric pump (23) before the thermostat (22) opens and cooling water is introduced into the radiator (21).

9 Claims, 6 Drawing Sheets

ENGINE COOLING DEVICE

CROSS REFERENCE TO RELATED APPLICATIONS

This application is a National Stage of International Application No. PCT/JP2010/053843 filed Mar. 9, 2010, the contents of which are incorporated herein by reference in their entirety.

FIELD OF THE DISCLOSURE

The present invention relates to an engine cooling device that stops circulation of cooling water until the cooling water temperature reaches a predetermined temperature, thereby promoting warm-up.

BACKGROUND OF THE DISCLOSURE

As an internal combustion engine cooling device, a water-cooled cooling device is generally known, in which cooling water is circulated in a water jacket formed in a cylinder block and a cylinder head to cool the cylinder block and the cylinder head. Such a water-cooled cooling device is generally configured of a pump, a water jacket, a radiator, a cooling water passage connecting the water jacket to the radiator, and a thermostat for adjusting the flow rate of the cooling water introduced into the radiator.

In recent years, a pump such as an electric pump, which is capable of changing the discharge performance without depending on the engine operating state has been put to practical use as a pump for circulating cooling water. For example, a cooling device described in Patent Document 1 adopts such an electric pump, and halts the operation of the pump until the cooling water temperature reaches a predetermined temperature at activation of the engine and the like, thereby halting circulation of the cooling water, thereby promoting warm-up.

In such a cooling device, when the cooling water temperature exceeds the predetermined temperature and warm-up proceeds to some extent, the electric pump is activated to start circulation of the cooling water. After start of circulation of the cooling water, when the cooling water temperature further rises, the thermostat is opened and the cooling water begins to be introduced into the radiator. As a result, heat of the cooling water is radiated to the outside by the radiator, and the heat-radiation amount and the heat-absorption amount absorbed by the cooling water through engine combustion achieve a state of equilibrium. Thus, the cooling water temperature is kept substantially constant and the temperature of the internal combustion engine is also kept at a proper temperature in operation.

PRIOR ART DOCUMENT

Patent Document

Patent Document 1: Japanese Laid-Open Patent Publication No. 2006-214280

SUMMARY OF THE INVENTION

Problems that the Invention is to Solve

Since the degree of opening of the thermostat is still small at an initial stage in which the thermostat starts to be opened, the flow rate of the cooling water introduced from the water jacket into the radiator is low. Especially after halt of circulation of the cooling water is cancelled, in the case where the amount of circulated cooling water is limited to a predetermined amount or less until a predetermined period elapses, the flow rate of the cooling water introduced into the radiator is further limited to suppress occurrence of thermal shock (heat shock) in each site of an engine cooling system.

Since the radiator is configured of an aggregate including a plurality of independent flow channels, the following disadvantages occur when the flow rate of the cooling water introduced into the radiator is low.

That is, as shown in FIG. 7, cooling water introduced into a radiator 41 concentrates in the most convenient routes in each of flow channels 42, 43 in the radiator 41. That is, in the radiator 41, flow of the cooling water is not uniform in the flow channels, and the flow concentrates on the certain flow channel 42, that is, uneven flow occurs. In the case where the temperature of the radiator, in other words, the cooling water temperature retained in each of the flow channels 42, 43 is extremely low, for example, in an extremely cool period, when the above-mentioned uneven flow occurs, a large temperature difference is generated between the place where high-temperature cooling water heated by engine combustion flows and the place where the cooling water remains retained, contributing to thermal strain in radiator 41. Then, if such thermal strain temporarily becomes excessive and thus, a large thermal stress is applied, or such thermal strain frequently occurs each time the engine is activated and thermal fatigue proceeds, the durability of the radiator 41 is greatly decreased.

Such a problem is not limited to the internal combustion engine cooling device having the above-mentioned radiator, and is substantially common to general cooling devices that have a heat exchanger configured as an aggregate including a plurality of independent channels and halt circulation of the cooling water because engine cooling is not required until the cooling water temperature reaches the predetermined temperature or higher.

The present invention is made in consideration of such conventional circumstance and its objective is to provide an engine cooling device that halts circulation of cooling water until the cooling water temperature reaches a predetermined temperature, the engine cooling device being capable of preventing thermal strain from occurring when halt of circulation of the cooling water is cancelled and the cooling water heated by heat of the engine is introduced into the heat exchanger, and preventing the durability of the radiator from being lowered due to the thermal strain.

Means for Solving the Problems

To achieve the foregoing objective and in accordance with one aspect of the present invention, an engine cooling device is provided that includes a pump configured to change discharge performance of cooling water supplied to an engine cooling system without depending on engine operating state, a heat exchanger configured to circulate the cooling water between the heat exchanger and the engine cooling system, a detection unit configured to detect temperature of the cooling water, and a control unit configured to control the pump to halt circulation of the cooling water when the detected cooling water temperature is lower than a predetermined temperature. The engine cooling device further includes a flow channel control valve configured to open when the cooling water temperature is equal to or higher than a predetermined valve opening temperature previously set to be equal to or higher than the predetermined temperature to allow the cooling water to be introduced into the heat exchanger. The control unit performs displacement increasing processing for increasing discharge pressure of the pump when the cooling water temperature is lower than the valve opening temperature.

With this configuration, through the discharge pressure increasing processing, after the pump discharge pressure increases, the flow channel control valve opens and then, the cooling water is introduced into the heat exchanger. Thus, the flow rate at which the cooling water is introduced into the heat exchanger can be increased, and the occurrence of uneven flow of the cooling water within the heat exchanger can be mitigated. For this reason, even when the heat exchanger is placed under the extremely low-temperature environment, the durability of the heat exchanger is prevented from being degraded due to the occurrence of uneven flow.

The present invention may also be embodied as an engine cooling device that includes a pump configured to change discharge performance of cooling water supplied to an engine cooling system without depending on an engine operating state, a heat exchanger configured to circulate the cooling water between the heat exchanger and the engine cooling system, a detection unit configured to detect temperature of the cooling water, and a control unit configured to control the pump to halt circulation of the cooling water when the detected cooling water temperature is lower than a predetermined temperature. The control unit performs discharge pressure increasing processing for increasing a discharge pressure of the pump before the cooling water temperature becomes equal to or higher than the predetermined temperature and the cooling water is introduced into the heat exchanger.

With this configuration, by increasing the discharge pressure of the cooling water according to the discharge pressure increasing processing, the flow rate at which the cooling water is introduced into the heat exchanger can be increased, and the occurrence of uneven flow of the cooling water within the heat exchanger can be mitigated. As a result, even when the heat exchanger is placed under the extremely low-temperature environment, it is possible to prevent the occurrence of thermal strain in the heat exchanger due to the occurrence of uneven flow as well as lowering of durability of the heat exchanger due to such thermal strain.

The present invention may further include a flow channel control valve configured to open when the cooling water temperature is equal to or higher than a predetermined valve opening temperature to allow the cooling water to be introduced into the heat exchanger. The control unit performs the discharge pressure increasing processing when the detected cooling water temperature is lower than the valve opening temperature.

The discharge pressure increasing processing is performed before the cooling water is introduced into the heat exchanger. This processing may be started on condition that the cooling water temperature detected by the detection unit reaches the valve opening temperature of the flow channel control valve and the flow channel control valve begins to open, or may be started when the cooling water temperature is rising and has not reached the valve opening temperature of the flow channel control valve.

The present invention may be embodied such that, after the detected cooling water temperature rises and reaches the predetermined temperature and until the cooling water temperature reaches a second predetermined temperature that is higher than the predetermined temperature, the control unit sets the driving mode of the pump to an intermittent operation for intermittently discharging the cooling water and drives the pump in a low-flow rate mode, in which a displacement of the cooling water is limited. The detected cooling water temperature becomes equal to or higher than the second predetermined temperature, the control unit changes the driving mode of the pump to a continuous operation for continuously discharging the cooling water and drives the pump in a high-flow rate mode having a larger pump discharge pressure than the low-flow rate mode.

With this configuration, when the cooling water temperature rises from the state where circulation of the cooling water is halted, and reaches the predetermined temperature, the pump starts its operation. In this case, first, the driving mode of the pump is set to the intermittent operation, and the pump is driven in the low-flow rate mode in which the displacement is limited to a low flow rate. Since the cooling water is circulated in the state where the pump displacement is limited to low flow rate, thermal shock caused when the large amount of high-temperature cooling water in the vicinity of an engine high-temperature portion is introduced into other portions of the engine cooling system can be mitigated, and local boiling of the cooling water in the vicinity of the engine high-temperature portion can be suppressed. Moreover, since the pump is intermittently operated in this low-flow rate mode, a pump average displacement in a predetermined period can be set to an extremely-low flow rate, and a suitable amount of cooling water in mitigating thermal shock caused when the high-temperature cooling water is introduced into a low-temperature portion can be circulated while suppressing local boiling of the cooling water. Then, when the cooling water temperature further increases, the pump driving mode is changed to continuous operation, and the pump is driven in a high-flow rate mode having a higher pump discharge pressure than the low-flow rate mode. As a result, a sufficient amount of circulated cooling water can be ensured and the engine cooling system can be cooled according to the engine temperature state at any time including after complete warm-up.

The present invention may be embodied such that the valve opening temperature is set between the predetermined temperature and the second predetermined temperature. The control unit performs the discharge pressure increasing processing when the pump is driven in the low-flow rate mode. After start of the discharge pressure increasing processing, the control unit sets a discharge halt period of the cooling water in the intermittent operation mode to be long such that the average displacement of the cooling water of the pump in a predetermined period is constant before and after the start of the discharge pressure increasing processing.

With this configuration, since the pump average displacement in the predetermined period does not change even when the discharge pressure increasing processing starts, cooling performance of the cooling water can be kept constant before and after the processing. For this reason, even when it is required to control the amount of circulated cooling water to make the cooling performance constant in order to suppress the occurrence of local boiling of the cooling water and thermal shock, the discharge pressure increasing processing can be performed while satisfying the requirement and the occurrence of uneven flow of the cooling water in the heat exchanger can be mitigated.

The present invention may further include an estimating unit configured to estimate an ambient temperature of the heat exchanger. The control unit sets an increase in the discharge pressure in the discharge pressure increasing processing such that the lower the estimated ambient temperature, the larger the increase in the discharge pressure becomes.

The lower the ambient temperature of the heat exchanger, the greater thermal strain of the heat exchanger due to uneven flow becomes and the higher the viscosity of the cooling water becomes, resulting in that uneven flow itself is easier to occur. With the above-mentioned configuration, as the ambient temperature of the heat exchanger is lower and the occurrence of thermal strain becomes more prominent, the discharge pressure of the cooling water, that is, the discharge pressure at the time when the cooling water is discharged in the intermittent operation, is increased. Thus, uneven flow can be reliably mitigated according to the temperature state of the heat exchanger. However, when the increase in the discharge pressure is increased, a discharge halt period of the cooling water is set to be longer. As a result, since the time when the cooling water is retained in the vicinity of the engine high-temperature portion becomes longer, the possibility that local boiling of the cooling water occurs becomes high. However, in the case where the increase in the discharge pressure is changed on the basis of the ambient temperature of the heat exchanger as in the above-mentioned configuration, when the ambient temperature of the heat exchanger is high, that is, advantage of thermal strain due to uneven flow is relatively small, the increase in the discharge pressure is small and thus, the discharge halt period of the cooling water is not set to be unnecessarily long. That is, with the above-mentioned configuration, the durability of the heat exchanger is prevented from being degraded by thermal strain due to uneven flow while preventing the occurrence of local boiling of the cooling water.

The present invention may be embodied such that the valve opening temperature is set to be higher than the second predetermined temperature. The control unit performs the discharge pressure increasing processing by changing the pump driving state from the low-flow rate mode to the high-flow rate mode, and the flow channel control valve is a temperature sensing valve that is autonomously opened/closed according to the cooling water temperature.

With this configuration, since the pump is put into the high-flow rate mode to increase the discharge pressure and then, the flow channel control valve opens and the cooling water is introduced into the heat exchanger, the flow rate of the cooling water introduced into the heat exchanger can be increased, and the occurrence of uneven flow of the cooling water in the heat exchanger can be mitigated. Further, since the amount of the cooling water that is introduced into the flow channel control valve and contacts the temperature sensing portion per time increases, temperature sensing performance improves and the flow channel control valve can be opened with a high responsiveness. As a result, the period during which the flow channel control valve reaches the valve opening temperature and is put into the fully opened state, that is, the period during which the degree of opening is narrowed can be shortened as much as possible. In this connection, the occurrence of uneven flow can be mitigated more preferably.

The present invention may further include an estimating unit configured to estimate an ambient temperature of the heat exchanger. The control unit includes, in conditions for performing the discharge pressure increasing processing, a condition that the estimated ambient temperature is lower than a predetermined threshold temperature.

With this configuration, even when ambient temperature of the heat exchanger is equal to or higher than the predetermined temperature, that is, uneven flow occurs in the heat exchanger, if the effect of resultant thermal strain is negligibly small, the discharge pressure increasing processing is not performed. Therefore, the pump supply mode of the cooling water such as the pump discharge pressure is prevented from being restricted with performance of the discharge pressure increasing processing, thereby improving the degree of freedom in the cooling water supply mode.

The present invention may be embodied such that a vehicle-mounted internal combustion engine is a target to be applied, and the heat exchanger is a radiator mounted in a front portion of a vehicle.

In the vehicle-mounted internal combustion engine, by halting circulation of the cooling water until the cooling water temperature reaches the predetermined temperature, it is possible to promote the warm-up to early stabilize engine combustion as well as to improve the thermal efficiency to reduce fuel consumption. However, since the radiator in the vehicle-mounted internal combustion engine is mounted in the front of the vehicle, the radiator is cooled by a vehicle relative wind while circulation of the cooling water is halted. Since temperature drop of the radiator is extremely large especially during a cool period having a low external temperature, thermal strain caused when uneven flow of the cooling water occurs in the radiator becomes large, resulting in that the effect on degradation of durability of the radiator becomes extremely severe. In this connection, with the above-mentioned configuration, even when the radiator is placed under the extremely low-temperature environment, the occurrence of uneven flow can be mitigated, thereby preventing the occurrence of thermal strain in the radiator, and degradation of durability of the radiator due to such thermal strain can be prevented.

DETAILED DESCRIPTION OF THE PREFERRED EMBODIMENTS

First Embodiment

A first embodiment according to the present invention will be described below with reference to FIGS. 1 and 2.

Figure 1:
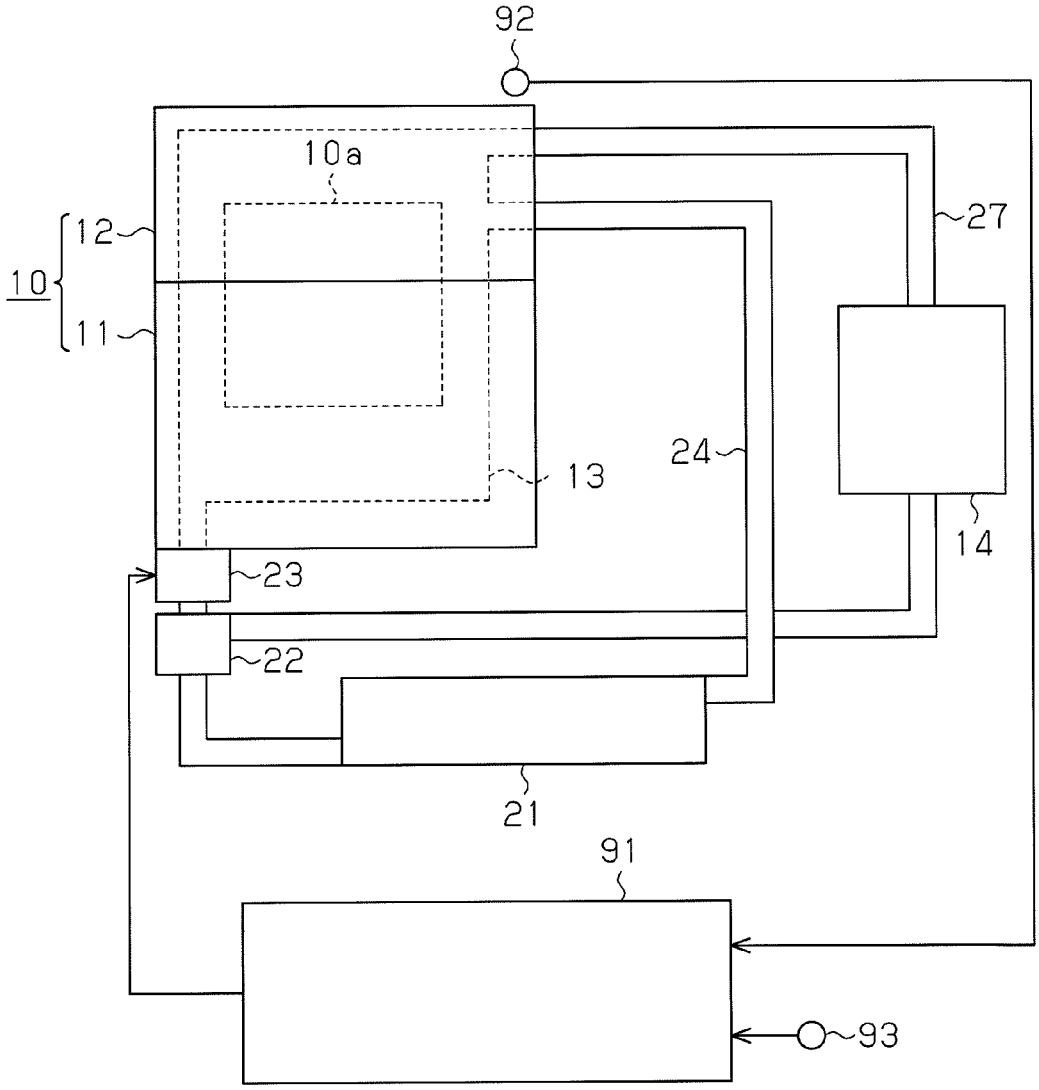
FIG. 1 is a schematic diagram showing the configuration of an internal combustion engine and a cooling device in accordance with a first embodiment of the present invention.
Figure 2:
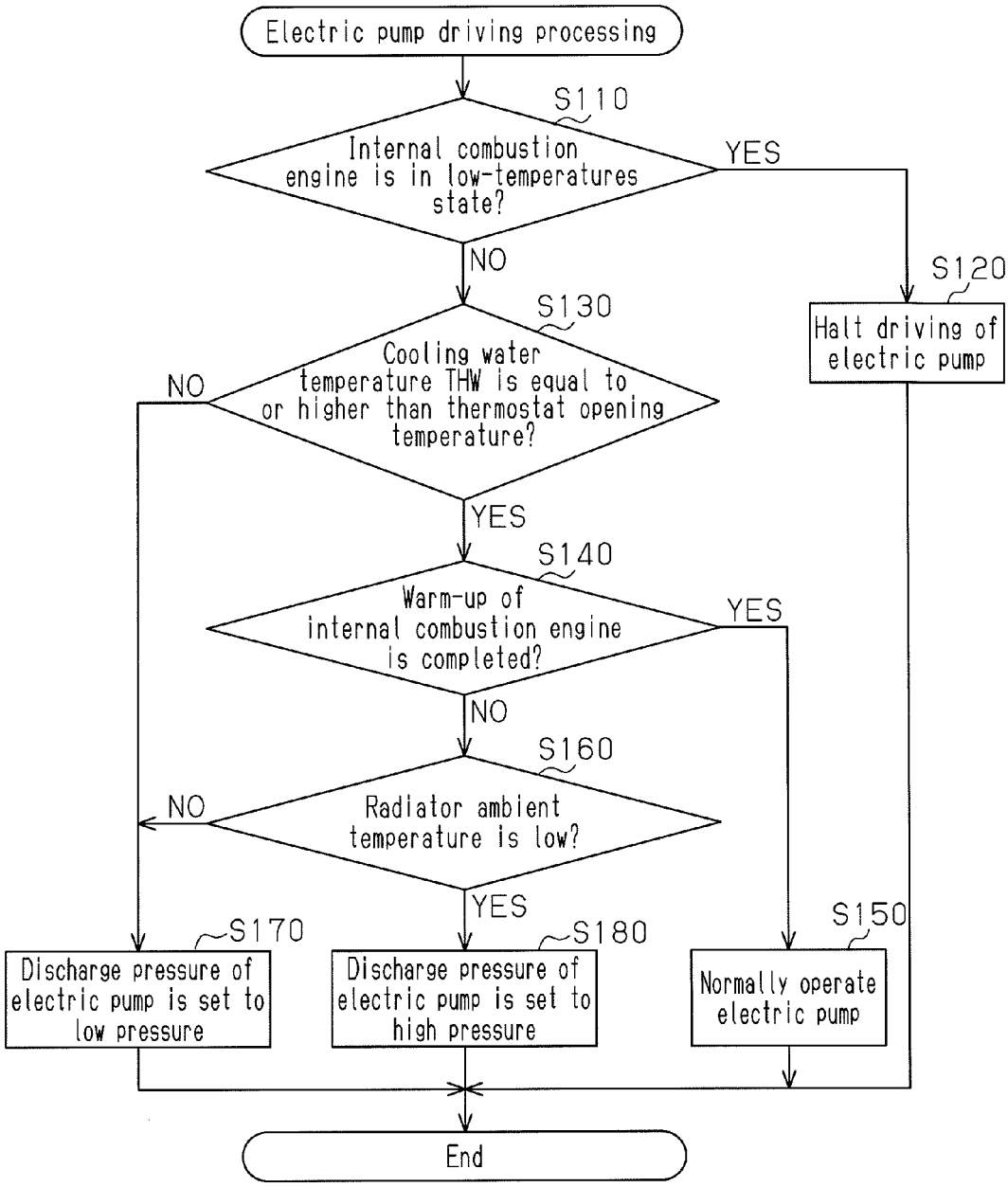
FIG. 2 is a flow-chart showing a procedure of electric pump driving processing in accordance with the first embodiment.

As shown in FIG. 1, a cooling device for a vehicle-mounted internal combustion engine 10 is roughly configured of a water jacket 13 formed around an engine combustion chamber 10*a* within a cylinder block 11 and a cylinder head 12, an electric pump 23, which discharges cooling water to the water jacket 13, and a main passage 24 and a sub passage 27, which cause the cooling water in the water jacket 13 to return to the electric pump 23 and circulate. The main passage 24 connects the water jacket 13 to the electric pump 23 through a radiator 21 and a thermostat 22. The radiator 21 is configured as an aggregate of a plurality of independent channels, and performs heat exchange between the cooling water flowing in these channels and external air to discharge heat of the cooling water to the outside. The radiator 21 is mounted in a front of a vehicle. The thermostat 22 functions as a channel switch valve that autonomously opens when a temperature of the cooling water in contact with a temperature sensing portion becomes equal to or higher than a predetermined temperature (hereinbelow referred to as a valve opening temperature TZ), that is, a temperature sensing valve. When the thermostat 22 opens, the main passage 24 communicates with the radiator 21 and the cooling water is introduced into the radiator 21 through the main passage 24.

The sub passage 27 connects the water jacket 13 to the electric pump 23 through a thermal component system 14 and the thermostat 22. This thermal component system 14 includes various components that utilize heat of the cooling water, such as a heater core, a heating passage of a throttle body and an EGR cooler, and together with the water jacket 13, constitutes the engine cooling system. The sub passage 27 is connected with the electric pump 23 at all times irrespective of the opened/closed state of the thermostat 22.

Accordingly, when the thermostat 22 is in the closed state, the cooling water discharged from the electric pump 23 to the water jacket 13 flows in the sub passage 27 including the thermal component system 14, is returned to the electric pump 23 and is discharged to the water jacket 13 again. No cooling water is introduced into the radiator 21 through the main passage 24.

In contrast, when the thermostat 22 is in the opened state, similarly, the cooling water discharged from the electric pump 23 to the water jacket 13 is returned from the sub passage 27 to the electric pump 23 and then, is discharged to the water jacket 13. In addition, the cooling water flows from the water jacket 13 in the main passage 24 including the radiator 21, is returned to the electric pump 23 and is discharged to the water jacket 13 again.

In the electric pump 23, an impeller coupled to an output shaft (not shown) of a motor rotates, thereby sucking and discharging the cooling water. The higher the motor rotational speed, the higher the discharge pressure (hereinbelow referred to as discharge pressure FV) of the electric pump 23. The electric pump 23 (more accurately, the motor thereof) is connected to a controller 91, and the controller 91 controls the driving mode of the pump. For example, the controller 91 changes a rotational pulse signal output from a driver circuit to the electric pump 23, thereby changing the motor rotational speed, that is, the discharge pressure FV. The controller 91 also selects a continuous operation for continuously discharging the cooling water or an intermittent operation for intermittently discharging the cooling water, as the driving mode of the electric pump 23. When the continuous operation is selected, the discharge pressure FV of the electric pump 23 is changed to adjust the amount of circulated cooling water. When the intermittent operation is selected, by changing a ratio of a driving period TPA during which the cooling water is discharged to a halt period TPB in which discharge of the cooling water is halted in addition to changing the discharge pressure FV, the amount of circulated cooling water is adjusted.

Various sensors including a water temperature sensor 92 that is attached in the vicinity of an outlet of the water jacket 13 and detects the cooling water temperature (hereinbelow referred to as cooling water temperature THW) and an intake air temperature sensor 93 that is attached to a intake air passage (not shown) of the internal combustion engine 10 and detects the temperature of intake air (hereinbelow referred to as intake air temperature GTA) are also connected to the controller 91. The controller 91 controls the driving mode of the electric pump 23 on the basis of detection values of these sensors. Since the intake air temperature GTA changes depending on the ambient temperature of the radiator 21, the intake air temperature GTA is used to estimate the ambient temperature as a substitute for the ambient temperature.

Next, driving mode of the electric pump 23, which is controlled by the controller 91, will be described. The controller 91 does not drive the electric pump 23 and halts circulation of the cooling water when the temperature of the internal combustion engine 10 is low, for example, at cold start, thereby promoting warm-up of the internal combustion engine 10 as well as keeping the temperature of a wall surface of the engine combustion chamber 10*a* to be high to reduce thermal loss, in turn, to improve fuel economy. Then, after warm-up of the internal combustion engine 10 progresses to some extent, the controller 91 drives the electric pump 23 and start circulation of the cooling water so that local boiling of the cooling water does not occur around the engine combustion chamber 10*a*.

However, unless the discharge pressure FV of the electric pump 23 is decreased to limit the amount of circulated cooling water to a certain amount, high-temperature cooling water retained in the vicinity of the engine combustion chamber 10*a* in the water jacket 13 is introduced into the low-temperature thermal component system 14 through the sub passage 27 and therefore, can give thermal shock to various low-temperature components included in the thermal component system 14. Moreover, since the wall surface temperature of the engine combustion chamber 10*a* rapidly lowers, thermal loss increases, leading to deterioration of fuel economy. For this reason, in canceling halt of circulation of the cooling water, the controller 91 first selects the intermittent operation and drives the electric pump 23 with a low discharge pressure FV (hereinbelow referred to as low discharge pressure FV1) to limit the amount of circulated cooling water to low flow rate (low-flow rate mode).

While the electric pump 23 is in the low-flow rate mode, when the thermostat 22 opens and the cooling water circulated with the low discharge pressure FV1 is introduced into the radiator 21, the flow of the cooling water is not uniform among the flow channels of the radiator 21 and concentrates on a certain flow channel, generating uneven flow. When such uneven flow occurs in the radiator 21, for example, in an extremely cold period, as described above, excessive thermal stress occurs or thermal fatigue proceeds, greatly degrading durability of the radiator 21.

Thus, in this embodiment, in the case where, when the ambient temperature of the radiator 21 is low and uneven flow occurs in the radiator 21, a considerable large thermal strain can occur in the radiator 21, the controller 91 performs discharge pressure increasing processing for increasing the discharge pressure FV of the electric pump 23.

General driving processing of the electric pump 23, which includes the discharge pressure increasing processing, will be described below with reference to a flowchart in FIG. 2. A series of processing shown in FIG. 2 is repeatedly performed from engine start every predetermined calculation cycle by the controller 91.

First, the controller 91 determines whether or not the internal combustion engine 10 is in the low-temperature state (Step S110). Specifically, the controller 91 determines whether or not the cooling water temperature THW is lower than a first predetermined temperature TX1. Through experimentation or the like, the first predetermined temperature TX1 is previously set as a value for determining whether or not local boiling of the cooling water is likely to occur in the vicinity of the engine combustion chamber 10*a* on the basis of comparison between the first predetermined temperature TX1 and the cooling water temperature THW.

When determining that the cooling water temperature THW is lower than the first predetermined temperature TX1, that is, when the internal combustion engine 10 is in the low-temperature state (Step S110: YES), the controller 91 halts driving of the electric pump 23 (Step S120). As a result, circulation of the cooling water is halted and warm-up of the internal combustion engine 10 is promoted.

In contrast, when determining that the cooling water temperature THW is equal to or higher than the first predetermined temperature TX1, that is, the internal combustion engine is not in the low-temperature state (Step S110: NO), the controller 91 starts circulation of the cooling water.

First, the controller 91 determines whether or not the cooling water temperature THW is equal to or higher than the valve opening temperature TZ of the thermostat 22 (Step S130). When the cooling water temperature THW is lower than the valve opening temperature TZ (Step S130: NO), the thermostat 22 is in the closed state, and no cooling water is introduced into the radiator 21 through the main passage 24. Thus, there is no possibility that uneven flow of the cooling water occurs in the radiator 21. For this reason, the controller 91 selects the low-flow rate mode, and sets the discharge pressure FV of the electric pump 23 to the above-mentioned low discharge pressure FV1, and further sets each of the driving period TPA and the halt period TPB of the electric pump 23 so that a suitable amount of cooling water for preventing the occurrence of thermal shock and the increase in thermal loss while suppressing the occurrence of local boiling of the cooling water is circulated (Step S170).

When determining that the cooling water temperature THW is equal to or higher than the valve opening temperature TZ (Step S130: YES), it is determined whether or not warm-up of the internal combustion engine 10 is completed (Step S140). Specifically, it is determined whether or not the cooling water temperature THW is lower than a second predetermined temperature TX2. Through experimentation or the like, the second predetermined temperature TX2 is previously set as a value for determining whether or not warm-up of the internal combustion engine 10 is completed on the basis of comparison between the second predetermined temperature TX2 and the cooling water temperature THW.

When determining that the cooling water temperature THW is equal to or higher than the second predetermined temperature TX2, that is, when warm-up of the internal combustion engine 10 is completed (Step S140: YES), the controller 91 normally operates the electric pump 23 (Step S150). That is, the controller 91 controls the electric pump 23 on the basis of parameters indicating the engine operating states such as the cooling water temperature THW, engine load and engine rotational speed.

In contrast, when determining that the cooling water temperature THW is lower than the second predetermined temperature TX2, that is, when warm-up of the internal combustion engine 10 is not completed (Step S140: NO), the controller 91 determines whether or not the ambient temperature of the radiator 21 is low (Step S160). Specifically, the controller 91 determines whether or not the intake air temperature GTA is lower than a predetermined threshold temperature α. Through experimentation or the like, the threshold temperature α is previously set as a value for determining whether or not the temperature of the radiator 21 is low and the adverse effect of the thermal strain caused when uneven flow occurs in the radiator 21 is considerable large on the basis of comparison between the predetermined threshold temperature α and the intake air temperature GTA.

When determining that the intake air temperature GTA is lower than the threshold temperature α, that is, when the ambient temperature of the radiator 21 is low (Step S160: YES), the controller 91 sets the discharge pressure FV to a high discharge pressure FV2 set to be higher than the above-mentioned low discharge pressure FV1 (Step S180). Through experimentation or the like, the high discharge pressure FV2 is previously set as a pressure that can sufficiently mitigate the occurrence of uneven flow in the radiator 21. Further, so that the average discharging flow rate in a predetermined period is constant before and after performance of discharge pressure increasing control, the controller 91 makes the driving period TPA of the electric pump 23 shorter and the halt period TPB of the electric pump 23 longer.

When determining that the intake air temperature GTA is equal to or higher than the threshold temperature a (Step S160: NO), the controller 91 selects the low-flow rate mode (Step S170). After the driving mode of the electric pump 23 is set in Steps S150, S170 and S180 in this manner, the controller 91 temporarily finishes the processing.

Figure 3A:
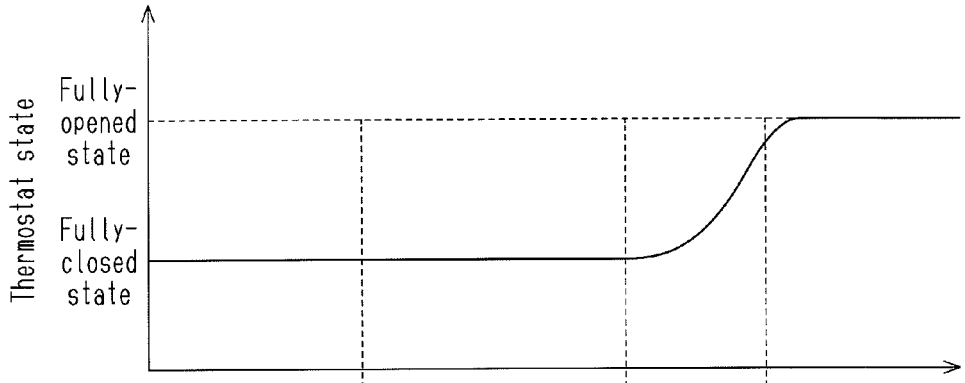
FIG. 3 is a timing chart showing an example of a driving mode of an electric pump in accordance with the first embodiment.
Figure 3B:
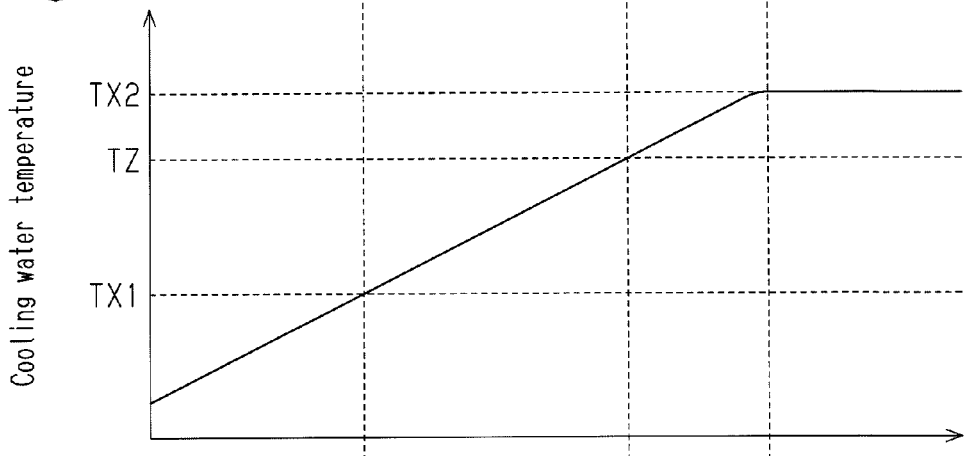
Figure 3C:
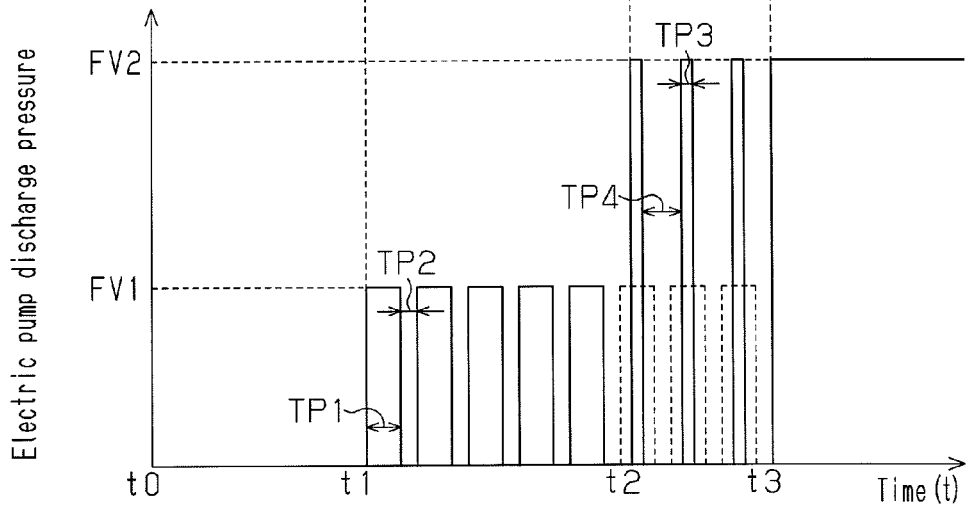

With regard to the case where the above-mentioned pump driving processing is performed, FIG. 3 shows changes in (a) the state of the thermostat 22, (b) the cooling water temperature THW and (c) the discharge pressure FV of the electric pump 23. FIG. 3(*c*) shows the driving mode of the electric pump 23 in a broken line in the case where the intake air temperature GTA is equal to or higher than the threshold temperature α.

In a period during which the cooling water temperature THW is equal to or lower than the first predetermined temperature TX1 (time t0 to time t1), for example, when only a short time elapses from engine start, the electric pump 23 is not driven, and circulation of the cooling water remains halted. Next, when the cooling water temperature THW rises and reaches the first predetermined temperature TX1, driving of the electric pump 23 is started (time t1). At this time, the controller 91 sets the discharge pressure FV of the electric pump 23 to the low discharge pressure FV1. Then, the driving period TPA and the halt period TPB are set to predetermined values TP1, TP2, respectively. The thermostat 22 is in the closed state until the cooling water temperature THW reaches the valve opening temperature TZ. Then, the cooling water temperature THW further rises and reaches the valve opening temperature TZ of the thermostat 22, if the intake air temperature GTA is lower than the threshold temperature α, the controller 91 sets the discharge pressure FV of the electric pump 23 to the high discharge pressure FV2. Further, the driving period TPA and the halt period TPB are set to predetermined values TP3, TP4, respectively (time t2) so that the above-mentioned relationship of the average displacement is satisfied before and after the discharge pressure FV is increased. After the cooling water temperature THW reaches the valve opening temperature TZ, the degree of opening of the thermostat 22 gradually increases with the increase in the cooling water temperature THW. When the cooling water temperature THW rises in this manner and reaches the second predetermined temperature TX2, the electric pump 23 is put into the continuous operation and is shifted to the normal state controlled on the basis of the engine operating state as described above (time t3 and thereafter).

When the cooling water temperature THW reaches the valve opening temperature TZ of the thermostat 22 but the intake air temperature GTA is equal to or higher than the threshold temperature α, as represented by a broken line in FIG. 3(*c*), the controller 91 keeps the driving state of the electric pump 23 in the low-flow rate mode in a period of time t2 to time t3 as in a period of time t1 to time t2.

The above-described embodiment can achieve following advantages.

(1) When the cooling water temperature THW reaches the valve opening temperature TZ, the discharge pressure FV of the electric pump 23 is increased from the low discharge pressure FV1 to the high discharge pressure FV2 to increase the flow rate at which the cooling water is introduced into the radiator 21 and therefore, the occurrence of uneven flow of the cooling water in the radiator 21 can be mitigated. Accordingly, even when the radiator 21 is placed under the extremely low-temperature environment, the thermal strain is prevented from occurring in the radiator 21 due to the occurrence of uneven flow, and the durability of the radiator 21 is prevented from being degraded due to such thermal strain.

(2) When the cooling water temperature THW reaches the first predetermined temperature TX1, the electric pump 23 is intermittently operated and shifts to the low-flow rate mode. For this reason, it is possible to suppress the occurrence of thermal shock caused when a large amount of high-temperature cooling water is introduced into the thermal component system 14 and the increase in thermal loss caused when the wall surface temperature of the engine combustion chamber 10*a* rapidly lowers, while preventing local boiling of the cooling water in the vicinity of the engine combustion chamber 10*a*.

(3) Since the average displacement of the electric pump 23 in the predetermined period is not changed even when the discharge pressure increasing processing starts, the cooling performance of the cooling water can be kept constant before and after the processing. For this reason, even when it is required to control the amount of circulated cooling water to make the cooling performance constant in order to suppress local boiling of the cooling water, the occurrence of thermal shock, and the increase in thermal loss caused by lowering of the wall surface temperature of the engine combustion chamber 10*a*, the discharge pressure increasing processing can be performed while satisfying the requirement.

(4) When intake air temperature GTA is equal to or higher than the threshold temperature α, that is, even when uneven flow occurs in the radiator 21, the displacement increasing processing is not performed if the adverse effect of the resultant thermal strain is negligibly small. As a result, the displacement increasing processing is prevented from restricting the cooling water supply mode such as the discharge pressure FV of the electric pump 23, which improves the degree of freedom in the cooling water supply mode.

(5) By halting circulation until the cooling water temperature THW reaches the first predetermined temperature TX1, warm-up can be promoted to early stabilize engine combustion and the thermal efficiency can be improved to reduce fuel consumption. However, since the radiator 21 is mounted in the front of the vehicle, the radiator 21 can be cooled by the vehicle relative wind while circulation of the cooling water is halted. Since temperature drop of the radiator 21 becomes extremely large especially in the period during which the external air temperature is low, thermal strain caused when uneven flow of the cooling water occurs becomes large, which has an extremely severe influence on lowering of durability of the radiator 21. In this connection, in this embodiment, even when the radiator 21 is placed under the extremely low-temperature environment, the occurrence of uneven flow can be mitigated and the occurrence of thermal strain in the radiator 21 can be also suppressed. Further, the durability of the radiator 21 is prevented from being degraded due to such thermal strain.

Second Embodiment

A second embodiment according to the present invention will be described centering on differences between the first embodiment and the second embodiment with reference to FIGS. 4(*a*) and 4(*b*). The same components as those in the first embodiment are given the same reference numerals and detailed description thereof is not repeated here.

In the electric pump driving processing of the cooling device in accordance with this embodiment, the controller 91 halts driving of the electric pump 23 until the cooling water temperature THW reaches the first predetermined temperature TX1. Then, after the cooling water temperature THW reaches the first predetermined temperature TX1 and until the cooling water temperature THW reaches the valve opening temperature TZ, the controller 91 drives the electric pump 23 in the low-flow rate mode. Then, when the cooling water temperature THW reaches the valve opening temperature TZ, if the intake air temperature GTA is lower than the threshold temperature α, the electric pump 23 is changed to the continuous operation, and the discharge pressure FV is set to the high discharge pressure FV2 set to be higher than the low discharge pressure FV1 (high-flow rate mode).

Figure 4A:
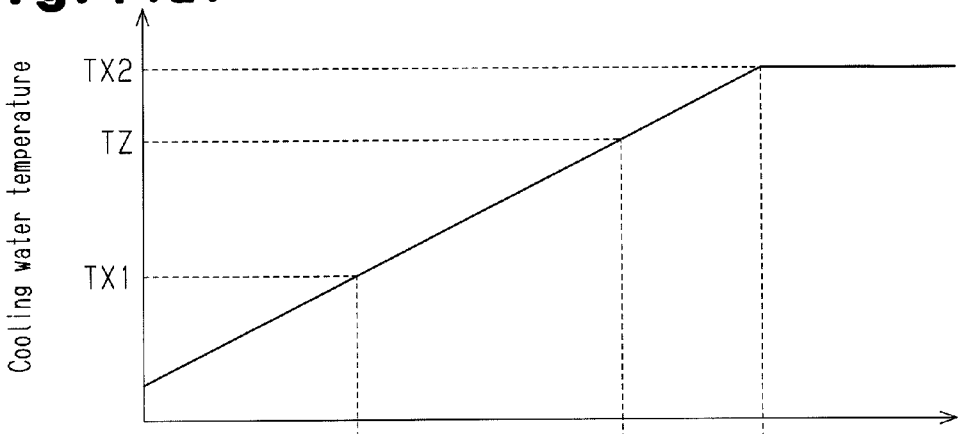
FIG. 4 is a timing chart showing changes in (a) the cooling water temperature, (b) the driving mode of the electric pump in accordance with a second embodiment, and (c) the driving mode of the electric pump in accordance with another embodiment.
Figure 4B:
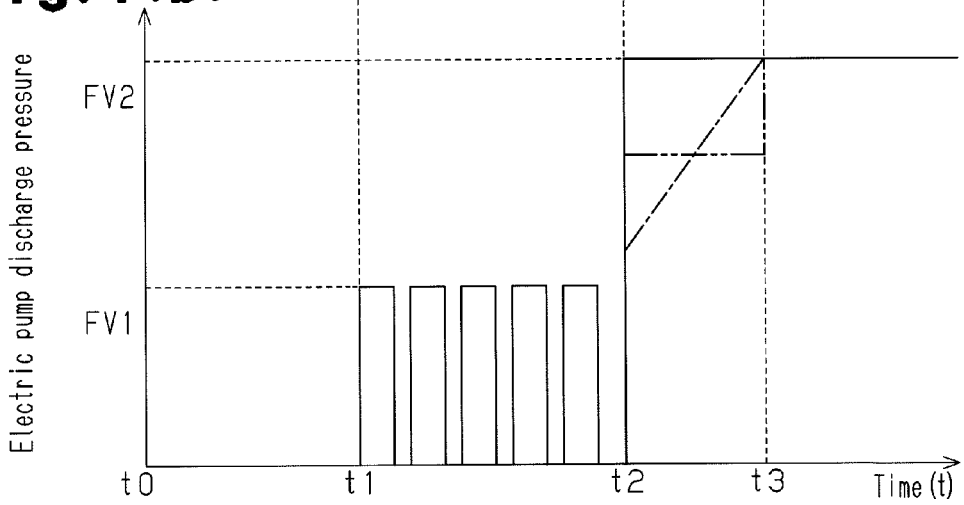
Figure 4C:
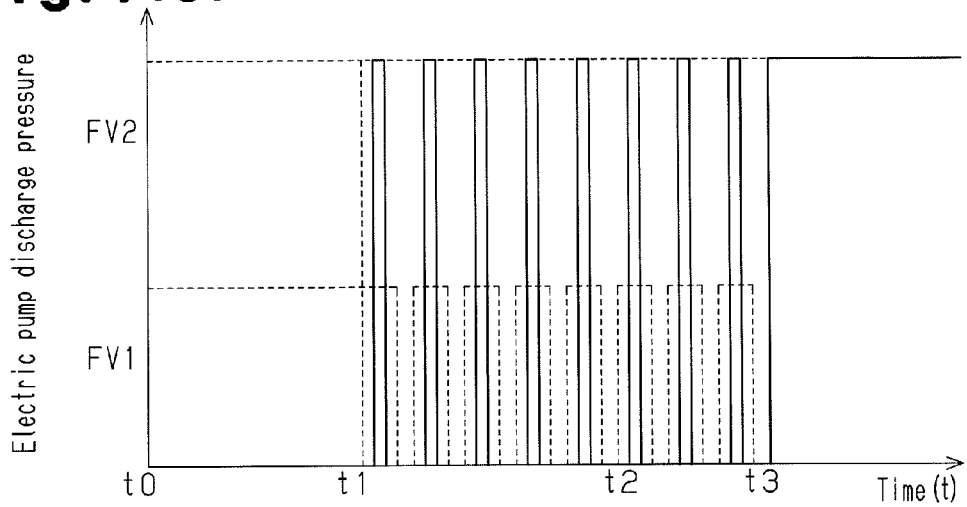

In the case where the electric pump driving processing in accordance with this embodiment is performed, FIG. 4 shows changes in (a) cooling water temperature THW and (b) the discharge pressure FV of the electric pump 23.

As shown in FIG. 4(*b*), the driving mode of the electric pump 23 until the cooling water temperature THW reaches the first predetermined temperature TX1 is the same as that in the first embodiment (time t0 to time t1). When the cooling water temperature THW rises and reaches the valve opening temperature TZ, if the intake air temperature GTA is lower than the threshold temperature α, as represented by a solid line in FIG. 4(*b*), the controller 91 performs the discharge pressure increasing processing for setting the discharge pressure FV of the electric pump 23 to the high discharge pressure FV2 (time t2). Then, when the cooling water temperature THW reaches the second predetermined temperature TX2, the electric pump 23 shifts to the normal operation (time t3).

The above-described embodiment can achieve following advantages in addition to the advantages described in above (1),(2),(4) and (5).

(6) When the cooling water temperature THW reaches the valve opening temperature TZ, the discharge pressure FV of the electric pump 23 is set to the high discharge pressure FV2, and the continuous operation is selected as the driving mode of the electric pump 23. For this reason, the sufficient amount of circulated cooling water can be ensured, and the engine cooling system can be cooled according to the engine temperature state at any time including time after complete warm-up.

The above-mentioned embodiments may be implemented in modes appropriately modified as described below. The above-mentioned embodiments and the modification may be appropriately implemented in combination if possible.

As represented by the line formed by a long dash alternating with two short dashes in FIG. 4(*b*), in the discharge pressure increasing processing described in the second embodiment, the discharge pressure FV of the electric pump 23 may be set to a value that is higher than the low discharge pressure FV1 and lower than the high discharge pressure FV2. Alternatively, the discharge pressure FV may be set to be higher than the high discharge pressure FV2. That is, in the discharge pressure increasing processing, the discharge pressure FV of the electric pump 23 only needs to be set to a value that is higher than the low discharge pressure FV1 set in the low-flow rate mode. This embodiment can achieve advantages similar to the above-mentioned advantages.

As represented by the line formed by a long dash alternating with a short dash in FIG. 4(*b*), when the discharge pressure increasing control starts, the discharge pressure FV of the electric pump 23 may be gradually increased. In this embodiment, when the discharge pressure increasing processing starts, the large amount of high-temperature cooling water is prevented from being introduced in the vicinity of the engine combustion chamber 10*a* into the components of the thermal component system 14, and thermal shock is prevented from occurring in the components.

As shown in FIG. 4(*c*), when the cooling water temperature THW reaches the first predetermined temperature TX1, the discharge pressure FV of the electric pump 23 may be set to the high discharge pressure FV2. At this time, it is preferred that the driving period TPA and the halt period TPB are set to the above-mentioned values TP3 and TP4, respectively. In this modification, since the discharge pressure FV of the electric pump 23 is set to the high discharge pressure FV2 and then, the thermostat 22 opens and the cooling water is introduced into the radiator 21, the flow rate of the cooling water introduced into the radiator 21 can be increased. For this reason, the occurrence of uneven flow in the radiator 21 can be suppressed in a more a favorable manner.

Figure 5A:
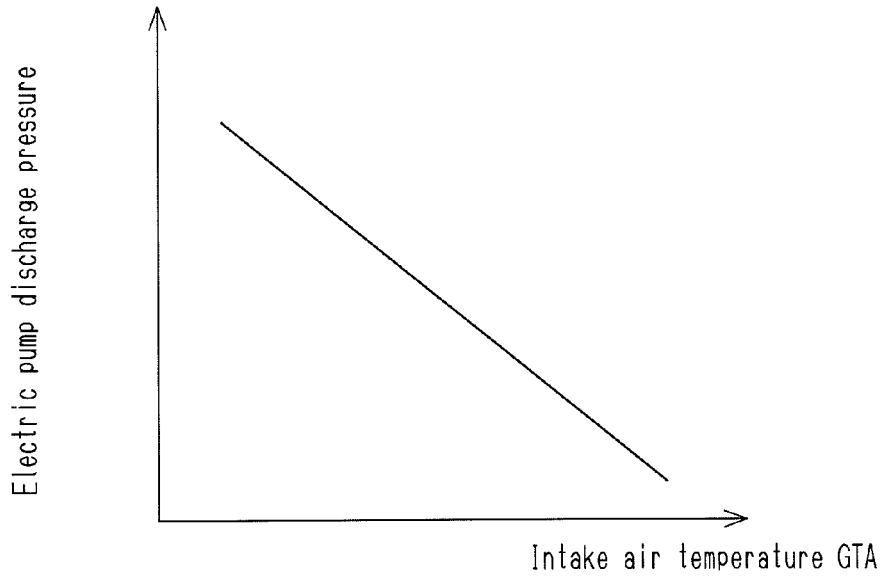
FIG. 5 is a graph showing (a) relationship between an intake air temperature and an electric pump discharge pressure, and (b) relationship between the intake air temperature and an electric pump driving mode in accordance with another embodiment.
Figure 5B:
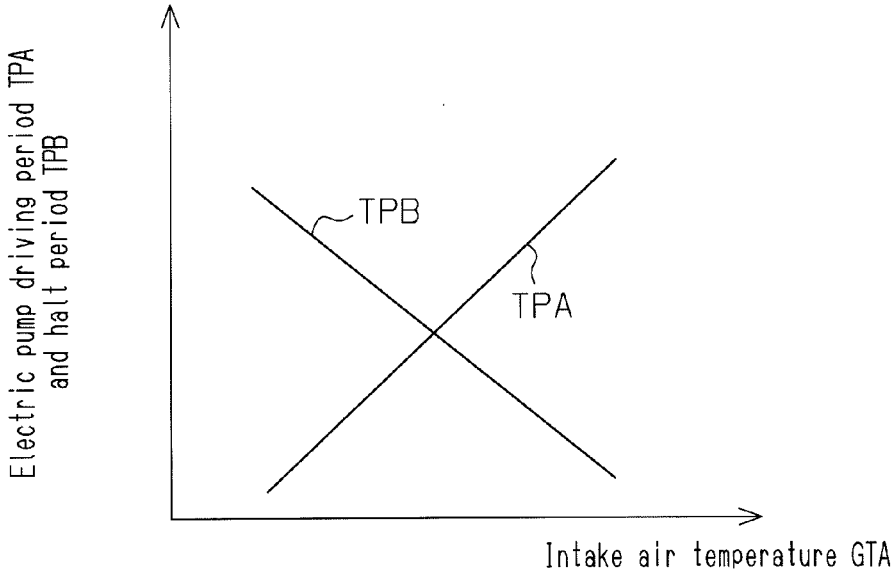

The discharge pressure FV of the electric pump 23 at the time when the discharge pressure increasing processing is performed is set to the previously set high discharge pressure FV2. However, as shown in FIG. 5(*a*), it may be configured such that the lower the intake air temperature GTA, the higher the discharge pressure FV of the electric pump 23 becomes, in other words, the higher an increase ΔFV in the discharge pressure FV becomes. The lower the intake air temperature GTA, that is, the lower the ambient temperature of the radiator 21, the greater the thermal strain of the radiator 21 due to uneven flow and the higher the viscosity of the cooling water becomes. Uneven flow itself is therefore more likely to occur. In this modification, since the discharge pressure FV of the electric pump 23 in the intermittent operation is increased as the ambient temperature of the radiator 21 is lower and the occurrence of thermal strain becomes more prominent, uneven flow can be preferably mitigated according to the ambient temperature state of the radiator 21.

In this modification, as shown in FIG. 5(*b*), it is desired that, by setting the driving period TPA to be shorter and the halt period TPB to be longer as the intake air temperature GTA is lower, that is, the discharge pressure FV of the electric pump 23 is larger, the average discharging flow rate in the predetermined period of the electric pump 23 is constant before and after performance of the discharge pressure increasing control. This modification can achieve the advantage similar to the advantage in the above (3). Further, in this modification, when the increase ΔFV of the discharge pressure FV is increased, the halt period TPB is set further longer, and the time when the cooling water is retained in the vicinity of the engine high-temperature portion or the like becomes longer and therefore, the possibility that local boiling of the cooling water occurs becomes high. However, by changing the increase ΔFV in the discharge pressure FV on the basis of the intake air temperature GTA, that is, the ambient temperature of the radiator 21 so as not to cause the above-mentioned problem, when the ambient temperature of the radiator 21 is high, that is, the advantage of thermal strain due to uneven flow is relatively small, the increase ΔFV in the discharge pressure FV becomes small and thus, the halt period TPB is not set to an unnecessarily long period. That is, the durability of the heat exchanger can be prevented from degrading by thermal strain due to uneven flow while avoiding the occurrence of local boiling of the cooling water.

The driving period TPA and the halt period TPB are set such that the average displacement of the cooling water in the predetermined period of the electric pump 23 is not changed before and after the start of the discharge pressure increasing processing. However, the driving period TPA and the halt period TPB may be independently set. This modification can achieve advantages similar to the advantage in the above (1), (2), and (4) to (6).

Figure 6:
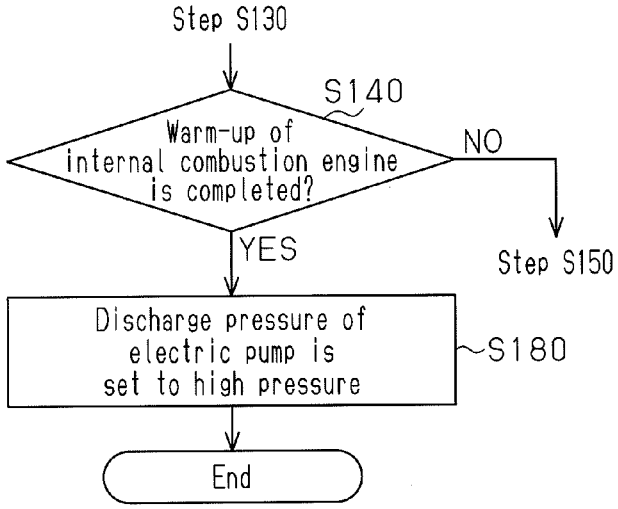
FIG. 6 is a timing chart showing an example of a driving mode of an electric pump in accordance with another embodiment.
Figure 7:
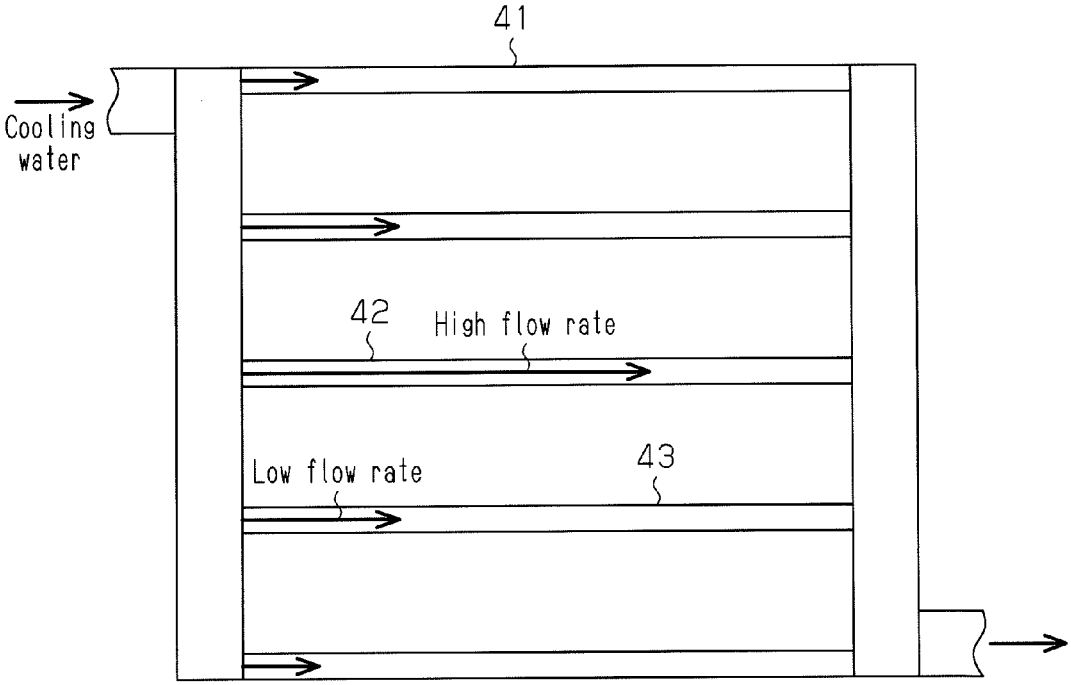
FIG. 7 is a schematic view showing a circulating mode of cooling water in a conventional radiator.

As shown in FIG. 6, when determining that warm-up of the internal combustion engine 10 is completed (Step S140: YES), the controller 91 sets the discharge pressure FV to the high discharge pressure FV2 set to be higher than the low discharge pressure FV1 at all times (Step S180) without performing determination on the intake air temperature GTA (FIG. 2: Step S160). That is, although the discharge pressure increasing processing is performed on condition that the ambient temperature of the radiator 21 is low in each of the above-mentioned embodiments, the discharge pressure increasing processing may be performed irrespective of the intake air temperature GTA. This modification can also achieve advantages that are similar to the advantage in above (1) to (3) and (5).

The cooling water temperature THW at which the discharge pressure increasing processing starts may be lower than the valve opening temperature TZ of the thermostat 22. In this modification, since the discharge pressure of the electric pump 23 is increased and then, the thermostat 22 opens and the cooling water is introduced into the radiator 21, the flow rate at which the cooling water is introduced into the radiator 21 can be increased, and uneven flow of the cooling water in the radiator 21 can be mitigated. Further, since the amount of the cooling water in contact with the temperature sensing portion of the thermostat 22 increases, the thermostat 22 can be opened with a high responsiveness. As a result, since the period during which the cooling water temperature THW reaches the valve opening temperature TZ and then, the thermostat 22 is put into the fully opened state, that is, the period during which the degree of opening of the thermostat 22 is narrowed can be decreased, the occurrence of uneven flow in the radiator 21 can be suppressed more preferably.

Although the electric pump 23 is driven in the low-flow rate mode when the cooling water temperature THW reaches the first predetermined temperature TX1 or more, driving of the electric pump 23 may be halted until the cooling water temperature THW reaches the valve opening temperature TZ. In this embodiment, since the period during which driving of the electric pump 23 is halted can be increased as much as possible, warm-up of the internal combustion engine 10 can be promoted to improve fuel economy.

Although the vehicle-mounted internal combustion engine cooling device in which the radiator is mounted in the front of the vehicle is used as an example of the engine cooling device in the above-mentioned embodiments, the engine cooling device according to the present invention is not limited to this. That is, as described above, the internal combustion engine is a typical example of an engine to which the cooling device is applied. However, the cooling device may also be applied to general engines in which circulation of the cooling water is halted until the cooling water temperature becomes equal to or higher than the predetermined temperature as cooling is unnecessary, for example, electric motors, electric generators and controllers such as inverters for controlling these electric motors and electric generators. The heat exchanger may be embodied as heat radiators other than the radiator mounted in the front of the vehicle, for example, a heater core included in the thermal component system 14 and a heat absorber such as an EGR cooler included in the thermal component system 14.

DESCRIPTION OF THE REFERENCE NUMERALS

10 . . . internal combustion engine, 10*a* . . . engine combustion chamber, 11 . . . cylinder block, 12 . . . cylinder head, 13 . . . water jacket, 14 . . . thermal component system, 21 . . . radiator, 22 . . . thermostat, 23 . . . electric pump, 24 . . . main passage, 27 . . . sub passage, 91 . . . controller (control unit), 92 . . . water temperature sensor (detection unit), 93 . . . intake air temperature sensor.

The invention claimed is:

1. An engine cooling device comprising:

a pump configured to change discharge performance of cooling water supplied to an engine cooling system without depending on engine operating state;

a heat exchanger configured to circulate the cooling water between the heat exchanger and the engine cooling system;

a detection unit configured to detect temperature of the cooling water; and a control unit configured to control the pump to halt circulation of the cooling water when the detected cooling water temperature is lower than a predetermined temperature, the engine cooling device further comprising a flow channel control valve configured to open when the cooling water temperature is equal to or higher than a predetermined valve opening temperature previously set to be equal to or higher than the predetermined temperature to allow the cooling water to be introduced into the heat exchanger, wherein the control unit performs displacement increasing processing for increasing discharge pressure of the pump when the cooling water temperature is lower than the valve opening temperature.

2. The engine cooling device according to claim 1, wherein after the detected cooling water temperature rises and reaches the predetermined temperature and until the cooling water temperature reaches a second predetermined temperature that is higher than the predetermined temperature, the control unit sets the driving mode of the pump to an intermittent operation for intermittently discharging the cooling water and drives the pump in a low-flow rate mode, in which a displacement of the cooling water is limited, and when the detected cooling water temperature becomes equal to or higher than the second predetermined temperature, the control unit changes the driving mode of the pump to a continuous operation for continuously discharging the cooling water and drives the pump in a high-flow rate mode having a larger pump discharge pressure than the low-flow rate mode.

3. The engine cooling device according to claim 2, wherein the valve opening temperature is set between the predetermined temperature and the second predetermined temperature, the control unit performs the discharge pressure increasing processing when the pump is driven in the low-flow rate mode, and after start of the discharge pressure increasing processing, the control unit sets a discharge halt period of the cooling water in the intermittent operation mode to be long such that the average displacement of the cooling water of the pump in a predetermined period is constant before and after the start of the discharge pressure increasing processing.

4. The engine cooling device according to claim 2, wherein the valve opening temperature is set to be higher than the second predetermined temperature, the control unit performs the discharge pressure increasing processing by changing the pump driving state from the low-flow rate mode to the high-flow rate mode, and the flow channel control valve is a temperature sensing valve that is autonomously opened/closed according to the cooling water temperature.

5. The engine cooling device according to claim 1, further comprising an estimating unit configured to estimate an ambient temperature of the heat exchanger, wherein the control unit sets an increase in the discharge pressure in the discharge pressure increasing processing such that the lower the estimated ambient temperature, the larger the increase in the discharge pressure becomes.

6. The engine cooling device according to claim 1, further comprising an estimating unit configured to estimate an ambient temperature of the heat exchanger, wherein the control unit includes, in conditions for performing the discharge pressure increasing processing, a condition that the estimated ambient temperature is lower than a predetermined threshold temperature.

7. The engine cooling device according to claim 1, wherein a vehicle-mounted internal combustion engine is a target to be applied, and the heat exchanger is a radiator mounted in a front portion of a vehicle.

8. An engine cooling device comprising:

a pump configured to change discharge performance of cooling water supplied to an engine cooling system without depending on an engine operating state;

a heat exchanger configured to circulate the cooling water between the heat exchanger and the engine cooling system;

a detection unit configured to detect temperature of the cooling water; and a control unit configured to control the pump to halt circulation of the cooling water when the detected cooling water temperature is lower than a predetermined temperature, wherein the control unit performs discharge pressure increasing processing for increasing a discharge pressure of the pump before the cooling water temperature becomes equal to or higher than the predetermined temperature and the cooling water is introduced into the heat exchanger.

9. The engine cooling device according to claim 8, further comprising a flow channel control valve configured to open when the cooling water temperature is equal to or higher than a predetermined valve opening temperature to allow the cooling water to be introduced into the heat exchanger, wherein the control unit performs the discharge pressure increasing processing when the detected cooling water temperature is lower than the valve opening temperature.

* * * * *